United States Patent [19]

Wallis

[11] Patent Number: 5,007,817

[45] Date of Patent: Apr. 16, 1991

[54] PRESS WITH DIE CUSHION GAS MONITOR

[76] Inventor: Bernard J. Wallis, 2215 Dacosta, Dearborn, Mich. 48128

[21] Appl. No.: 467,189

[22] Filed: Jan. 19, 1990

[51] Int. Cl.[5] ..... B30B 15/14; B30B 15/28

[52] U.S. Cl. ..... 425/136; 72/453.13; 100/53; 100/99; 425/151; 425/162; 425/169; 425/406

[58] Field of Search ..... 72/453.13; 100/43, 53, 100/99; 164/150–154; 425/135, 136, 151, 161, 162, 169, 406

[56] References Cited

U.S. PATENT DOCUMENTS

| | | | |
|---|---|---|---|
| 4,062,914 | 12/1977 | Hinzpeter | 425/136 |
| 4,635,466 | 1/1987 | Seki et al. | 72/453.13 |
| 4,669,298 | 6/1987 | Kono et al. | 72/453.13 |
| 4,939,918 | 7/1990 | Schoch | 72/453.13 |

FOREIGN PATENT DOCUMENTS

| | | | |
|---|---|---|---|
| 59432 | 9/1982 | European Pat. Off. | 72/453.13 |
| 227058 | 9/1985 | German Democratic Rep. | 72/453.13 |

*Primary Examiner*—Jay H. Woo
*Assistant Examiner*—James P. Mackey
*Attorney, Agent, or Firm*—Barnes, Kisselle, Raisch, Choate, Whittemore & Hulbert

[57] ABSTRACT

A press that includes a pair of die sections and a ram for propelling one of the die sections against the other to form a workpiece positioned therebetween. A die cushion is coupled to one of the die sections for cushioning force of engagement of the die sections, and includes at least one gas cylinder and a manifold for feeding gas under pressure to the cylinder. A pressure monitor includes a pressure sensor coupled to the manifold for supplying an electrical pressure signal as a function of gas pressure in the manifold. The pressure signal as compared to a predetermined threshold for supplying an alarm signal when gas pressure in the manifold is less than such threshold, and ram operation is stopped when the manifold gas pressure is less than the preset threshold.

11 Claims, 2 Drawing Sheets

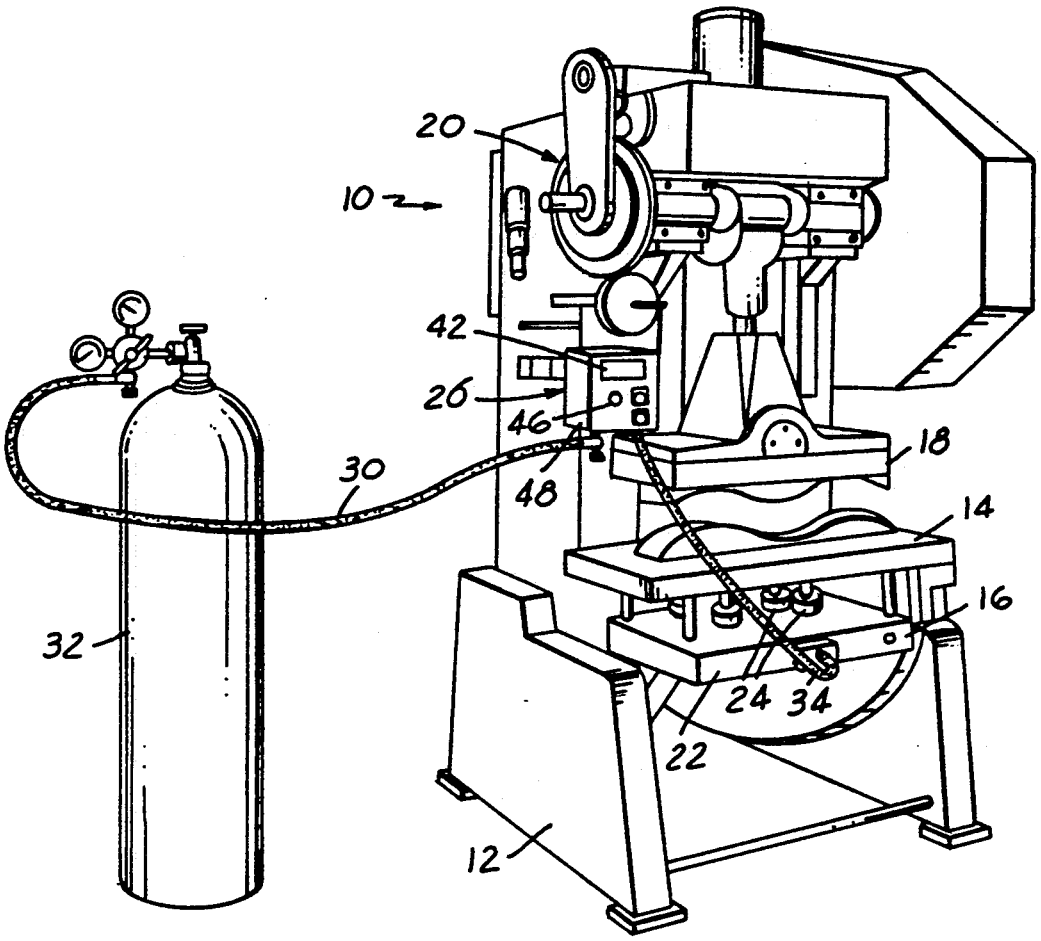
FIG. 1
FIG. 2
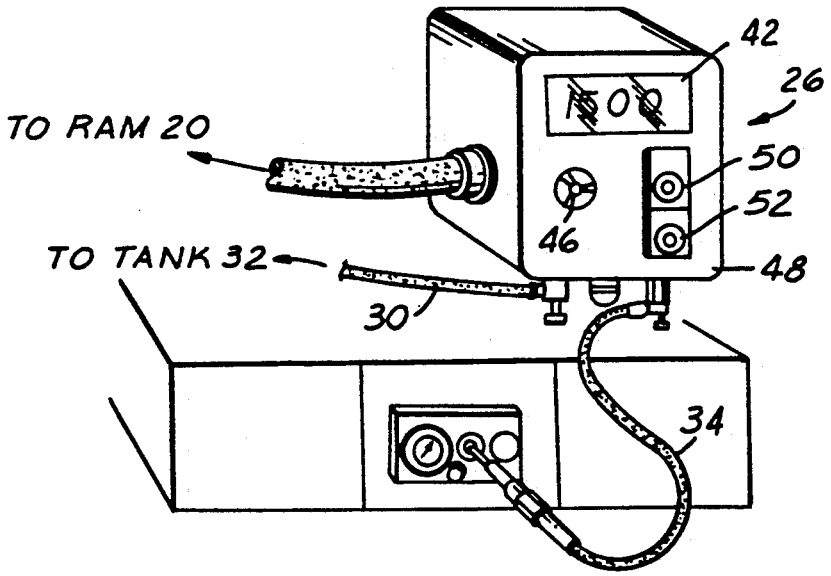

PRESS WITH DIE CUSHION GAS MONITOR

The present invention is directed to presses having gas spring cylinders in the die cushion, and more specifically to a device for controlling press operation as a function of gas pressure in the die cushion manifold.

BACKGROUND AND OBJECTS OF THE INVENTION

Presses of the subject character conventionally include a pair of die sections, and a ram or other suitable means for propelling one of the die sections against the other so as to form a workpiece positioned therebetween. A die cushion is coupled to one of the die sections for absorbing the force of die engagement. Typically, the die cushion has included a multiplicity of coil springs that engage the opposing die pad for resiliently absorbing the forces of die engagement. It has heretofore been proposed to replace such coil springs with gas spring cylinders coupled to a die cushion manifold. The manifold supplies gas under pressure to the cylinders for resiliently absorbing the force of die engagement. It is important in gas cylinder die cushions of the described character that manifold gas pressure be maintained within a range determined by press operation. If the gas pressure falls below the minimum desired level, due to cocking of the die pad or gas leakage for other reasons, not only will the press produce unsatisfactory workpieces, but continued operation could damage the press and result in significant downtime and repair cost.

It is therefore a general object of the present invention to provide a press of the described character that includes facility for monitoring gas pressure within the die cushion manifold and controlling operation of the press as a function of manifold gas pressure. A more specific object of the present invention is to provide a press of the described character in which press operation is disabled when die cushion gas pressure is below a preselected or predetermined minimum threshold. Another object of the present invention is to provide a press of the described character that includes facility for operator adjustment of the minimum manifold gas pressure threshold, and/or for automatically feeding gas under pressure to the manifold when manifold pressure is less than the minimum threshold.

SUMMARY OF THE INVENTION

A press in accordance with a presently preferred embodiments of the invention includes a pair of die sections and a ram for propelling one of the die sections against the other to form a workpiece positioned therebetween. A die cushion is coupled to one of the die sections for cushioning force of engagement of the die sections, and includes at least one gas cylinder and a closed manifold for feeding gas under pressure to the cylinder. A pressure monitor includes a pressure sensor coupled to the manifold for supplying an electrical pressure signal as a function of gas pressure in the manifold. The pressure signal is compared to a predetermined threshold for supplying an alarm signal when gas pressure in the manifold is less than such threshold, and ram operation is disabled when the manifold gas pressure is less than the preset threshold.

In the preferred embodiments of the invention, the ram includes an electrically operated clutch/brake or other suitable device responsive to application of electrical power for operating the ram, and the pressure monitor includes an electrical switch responsive to the alarm signal for removing electrical power from the ram and thereby disabling ram operation. The gas manifold is coupled by a valve to a source of gas under pressure. The valve may comprises a manual valve to be opened by an operator for feeding additional gas to the manifold, or an electrically operated valve responsive to the alarm signal for automatically recharging the gas manifold. In the latter case, when the manifold pressure exceeds a second threshold corresponding to maximum desired manifold pressure, the valve is automatically closed to terminate further gas flow to the manifold. The pressure monitor includes an LCD for displaying manifold pressure to an operator, and an audible alarm for indicating an alarm condition.

BRIEF DESCRIPTION OF THE DRAWINGS

The invention, together with additional objects, features and advantages thereof, will be best understood from the following description, the appended claims and the accompanying drawings in which:

FIG. 1 is a perspective schematic diagram of a press equipped with a manifold gas monitor in accordance with a presently preferred embodiment of the invention;

FIG. 2 is a fragmentary schematic view on an enlarged scale of a portion of the press illustrated in FIG. 1;

DETAILED DESCRIPTION OF PREFERRED EMBODIMENTS

Figure 3:
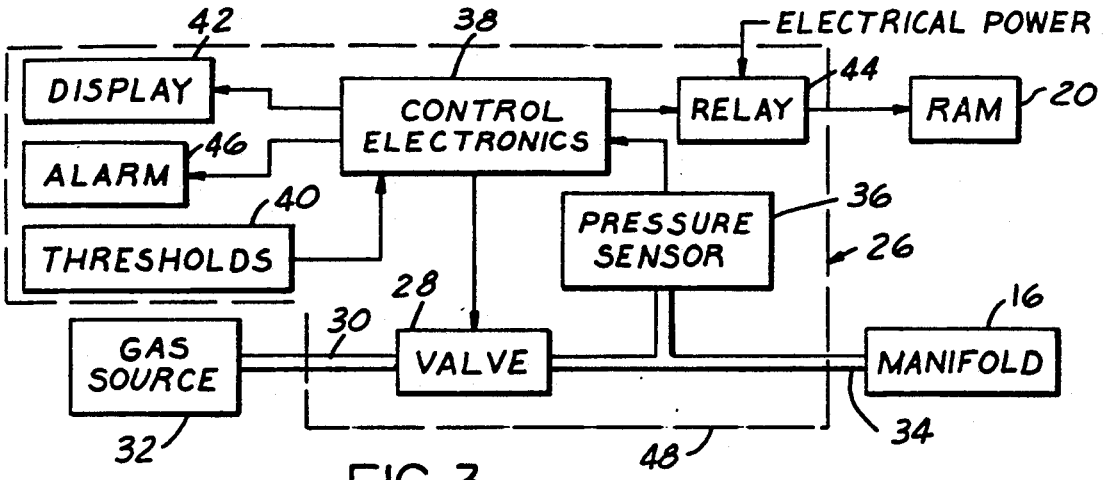
FIG. 3 is a functional block diagram of the press in FIGS. 1 and 2.

FIGS. 1–3 illustrate a press 10 in accordance with a presently preferred embodiment of the invention as comprising a base or frame 12 on which a lower die section 14 is carried by a die cushion 16. An upper die section is mounted on a ram 20 which is mounted on the base 12 for vertical reciprocation toward and way from lower die section 14. Die sections 14, 18 have opposed surfaces contoured to form a workpiece positioned therebetween. (The contours of the die sections, and the nature of the forming operation do not per se form part of the present invention.) Die cushion 16 includes a gas manifold 22 and a plurality of gas spring cylinders 24, which are carried by the manifold and have actuators that support lower die section 14. Manifold 22 includes suitable internal passage for containing and communicating gas under pressure to the various cylinders 24.

To the extent thus far described, press 10 is of conventional construction. Upper die section 18 is reciprocated by ram 20 against lower die section 14 to perform a forming operation on a workpiece position therebetween. The force of engagement of the upper die section against the lower die section is absorbed in part by gas cylinders 24. Thus, as is well-know in the art, it is important to maintain gas pressure within cylinders 24 and manifold 22 within predetermined designed limits. Manifold and cylinder gas pressures up to 1500 psi are typical. Nitrogen gas is preferred. In accordance with the present invention, a device 26 is mounted on base 12 for monitoring manifold gas pressure and controlling operation of ram 20 as a function thereof.

Monitor device 26 comprises a normally closed electromagnetic valve 28 (FIG. 3) that is connected by a hose 30 to a source 32 of gas under pressure, such as a nitrogen tank. Valve 28 is also connected by a second hose 34 to manifold 16. A pressure sensor 36 is coupled to the output side of valve 28 connected to manifold 16, and supplies a electrical signal to a control electronics package 38 that varies as a function of manifold gas pressure. Sensor 36 may be of any suitable character, such as a conventional pressure sensor that supplies an analog signal to the control electronics. The control electronics, which may be of either analog or digital construction, receives an input from a variable resistor 40 or other suitable device for setting pressure threshold values within the control electronics. One output of control electronics 38 is fed to a digital multi-segment LCD 42 or other suitable display for indicating manifold gas pressure to an operator. That is, the output of sensor 36 is digitized by the control electronics and indicated at display 42. Another output of the control electronics is connected to the control input of a relay 44 or other suitable electronic switch for selectively applying electrical power to ram 20. A third output of the control electronics is coupled to the actuator of valve 28, and a forth output drives an audible alarm 46. Monitor 26 is contained within a suitable enclosure 48, which has a pair of switches 50, 52 respectively for selecting automatic operation of the monitor and application of power thereto.

In operation, the minimum and maximum manifold gas pressure thresholds are set by an operator in a calibration mode of operation. During the calibration mode of operation, enclosure 48 is removed, and variable resistors 40 within the enclosure are manipulated by the operator. These resistors are not accessible without removing the enclosure. The calibration values are displayed at LCD 42. With the enclosure reinstalled, the operator then switches to automatic operation by manipulation of switch 50. During automatic operation, the output of pressure sensor 36 is compared with the low limit threshold. If manifold gas pressure, which is displayed at LCD 42 during normal operation, is above the minimum threshold level, relay 44 is closed to apply electrical power ram 20, and the press operates in the normal manner.

Manifold gas pressure is continuously monitored by sensor 36. If sufficient gas leaks from the manifold, due to a cocked die pad, wear or any other reason, such that the manifold gas pressure drops below the minimum pressure threshold, control electronics 38 deenergizes relay switch 44 and thereby removes electrical power from the clutch/brake mechanism of ram 20. Operation of the pressure ram is thereby disabled. When press operation is disabled as previously described, an audible alarm 46 is also energized. In the meantime, in the automatic mode of operation, valve 28 is opened by control electronics 36 to feed gas under pressure from source 32 to manifold 16. When the manifold gas pressure indicated by sensor 36, reaches the upper preset design threshold, valve 28 is closed. Relay switch 44 must be activated manually to restart operation of the press.

Figure 4:
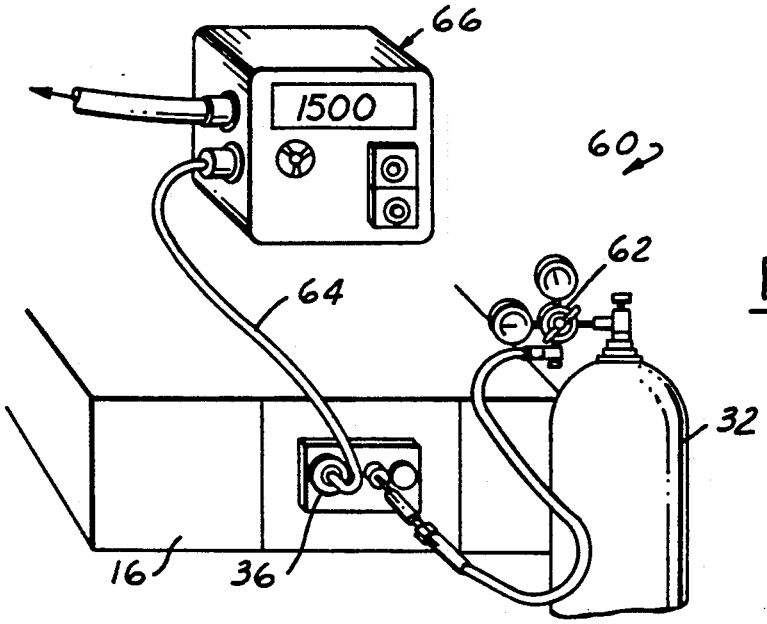
FIG. 4 is a fragmentary schematic diagram similar to that of FIG. 2 but illustrating a modified embodiment of the invention.
Figure 5:
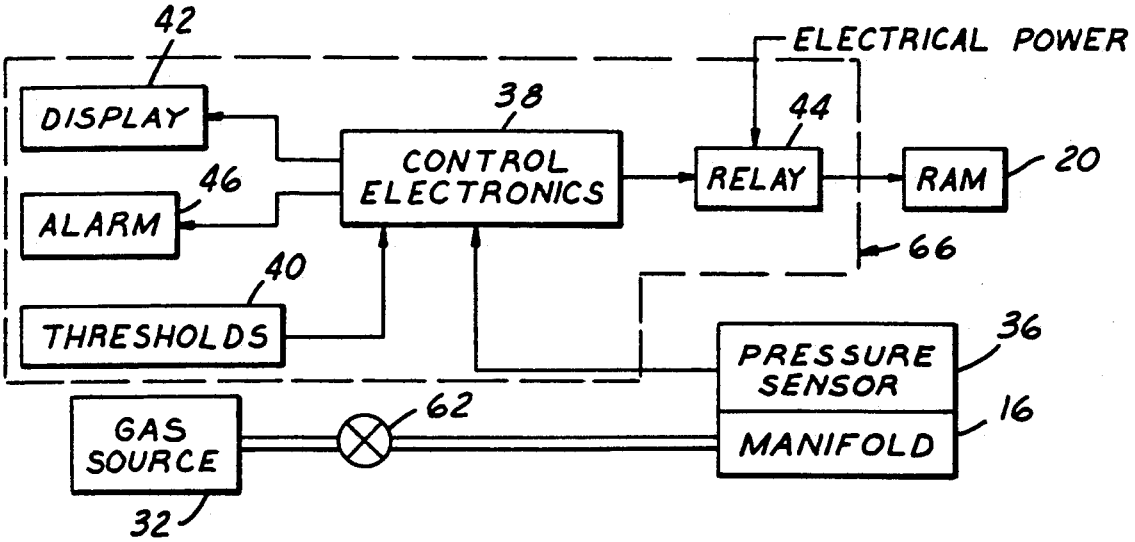
FIG. 5 is a functional block diagram of the embodiment of the invention illustrated schematically in FIG. 4.

FIGS. 4–5 illustrate a modified press 60 of the invention in which gas cylinder 32 is directly coupled to manifold 16 through the manual valve 62 on the gas cylinder. That is, the modified embodiment 60 of the present invention does not include the automatic gas valve 28 as in the embodiment of FIGS. 1–3. Pressure sensor 36 in the embodiment of FIGS. 4–5 is mounted on manifold 16, and is connected by a suitable cable 64 to the monitor electronics package 66. Thus, when gas pressure in manifold 16 decreases below the minimum preset threshold, control electronics 38 disables operation of ram 20 and activates alarm 46. The gas pressure in manifold 16 is replenished by operator manipulation of valve 62. Otherwise the embodiment of 60 of FIGS. 4–5 is identical to that hereinabove described in connected with FIGS. 1–3.

Although the invention has been described in conjunction with two presently preferred embodiments thereof, it will be appreciated that any number of modifications may be implemented without departing from the spirit and scope of the present invention. For example, the gas source may include a suitable pump for increasing gas flow between the tank and the manifold. Relay switch 44 may take the form of any suitable electrical switch, such as a triac or other suitable device. As previously noted, control electronics 38 may be of either analog or digital construction. Likewise, display 42 may be of analog construction, although a digital display is currently preferred. Alarm 46 preferably includes a suitable switch for disabling the audible alarm at the operator's discretion.

I claim:

1. A pressure monitor for use in a press that includes a pair of die sections, a ram for propelling one of said die sections against the other for forming a workplace positioned therebetween, and a die cushion coupled to one of said die sections for cushioning force of engagement of said die sections, said die cushion including at least one gas cylinder coupled to said one section and a manifold for feeding gas under pressure to said cylinder, said pressure monitor comprising:

a pressure sensor coupled to said manifold for supplying an electrical pressure signal as a function of gas pressure in said manifold, means for comparing said pressure signal to a predetermined threshold for supplying an alarm signal when gas pressure in said manifold is less than said threshold, and means coupled to said ram and responsive to said alarm signal for disabling operation of said ram.

2. The monitor set forth in claim 1 wherein said ram comprises an electrically controlled ram, and wherein said ram-coupled means comprises electrical switch means responsive to said alarm signal for removing electrical power from said ram.

3. The monitor set forth in claim 1 further comprising display means responsive to said pressure signal for displaying manifold gas pressure to an operator.

4. The monitor set forth in claim 3 wherein said display means comprises a digital multi-segment LCD.

5. The monitor set forth in claim 1 further comprising means for adjustably setting said threshold.

6. The monitor set forth in claim 1 further comprising an audible alarm responsive to said alarm signal for indicating an alarm condition to an operator.

7. The monitor set forth in claim 1 further comprising a source of gas under pressure, and means for selectively feeding gas from said source to manifold.

8. The monitor set forth in claim 7 wherein said selectively feeding means comprises a manual valve.

9. The monitor set forth in claim 7, wherein said selectively feeding means comprises an electrical valve means for opening said electrical valve responsive to said comparing means for feeding gas from said source to said manifold when manifold gas pressure is below said threshold.

10. The monitor set forth in claim 9 further comprising means for comparing said pressure signal to a second threshold corresponding to maximum desired manifold pressure, and means for closing said electrical valve when manifold pressure exceeds said second threshold.

11. The monitor set forth in claim 10 further comprising means for adjustably setting both said thresholds.

* * * * *